US006007469A

United States Patent [19]

Jaegers et al.

[11] Patent Number: 6,007,469

[45] Date of Patent: Dec. 28, 1999

[54] METHOD FOR FORMING A HONEYCOMB CORNER PROTECTOR WITH SELF-LOCKING PANELS

[75] Inventors: Robert E. Jaegers, Lake Zurich; Raymond A. Kowalski, Mundelein, both of Ill.

[73] Assignee: Pactiv Corporation, Lake Forest, Ill.

[21] Appl. No.: 08/881,986

[22] Filed: Jun. 25, 1997

Related U.S. Application Data

[62] Division of application No. 08/640,661, May 1, 1996, Pat. No. 5,680,934.

[51] Int. Cl.[6] ..... B31B 1/14

[52] U.S. Cl. ..... 493/367; 493/89; 493/80; 493/138; 493/356; 493/373; 493/966

[58] Field of Search ..... 493/966, 968, 493/89, 69, 70, 71, 79, 80, 81, 82, 83, 136, 137, 138, 356, 357, 358, 359, 363, 369, 370, 342, 373, 366, 367; 53/139.7, 139.6, 139.5; 83/877, 876, 875

[56] References Cited

U.S. PATENT DOCUMENTS

| | | | |
|---|---|---|---|
| 2,006,224 | 6/1935 | Weber et al. . | |
| 2,024,224 | 12/1935 | Humphner | 493/89 |
| 2,174,585 | 10/1939 | Kotzich | 493/89 |
| 2,651,588 | 9/1953 | Bruce et al. | 493/89 |
| 3,220,683 | 11/1965 | Doll | 248/345.1 |
| 3,271,925 | 9/1966 | Aubery | 53/139.6 |
| 3,314,339 | 4/1967 | Guffy et al. | 493/403 |
| 3,349,984 | 10/1967 | Halko, Jr. | 229/14 |
| 3,481,813 | 12/1969 | Wiggers et al. | 493/354 |
| 3,555,137 | 1/1971 | Camody | 493/89 |
| 3,655,112 | 4/1972 | Jeffers | 229/14 C |
| 3,746,593 | 7/1973 | Majewshi et al. | 156/207 |
| 3,785,908 | 1/1974 | Wagers et al. | 493/344 |
| 3,843,038 | 10/1974 | Sax | 229/14 C |
| 3,890,108 | 6/1975 | Welsh | 29/191.4 |
| 3,900,156 | 8/1975 | Clark, Jr. | 229/14 C |
| 3,994,433 | 11/1976 | Jenkins et al. | 229/14 C |
| 4,194,313 | 3/1980 | Downing | 40/610 |
| 4,407,179 | 10/1983 | Iwase et al. | 83/875 |
| 4,566,237 | 1/1986 | Turner | 428/116 X |
| 4,596,541 | 6/1986 | Ward, Sr. et al. | 493/354 |
| 4,771,893 | 9/1988 | Liebel | 206/586 |
| 4,784,270 | 11/1988 | Layer et al. | 206/586 |
| 4,883,179 | 11/1989 | Dionne | 206/523 |
| 5,040,696 | 8/1991 | Liebel | 220/441 |
| 5,175,041 | 12/1992 | Webb et al. | 428/116 |
| 5,466,211 | 11/1995 | Komarek et al. | 156/257 X |
| 5,511,667 | 4/1996 | Carder | 206/586 |
| 5,752,909 | 5/1998 | Sagvik et al. | 493/363 |

FOREIGN PATENT DOCUMENTS

| | | | |
|---|---|---|---|
| 1125550 | 10/1956 | France | 493/136 |
| 004200024 | 7/1993 | Germany | 53/139.7 |
| 2081678 | 2/1982 | United Kingdom . | |

*Primary Examiner*—Peter Vo
*Assistant Examiner*—Matthew Luby
*Attorney, Agent, or Firm*—Arnold White & Durkee

[57] ABSTRACT

A method for forming a honeycomb protector for protecting the corners, edges or other surfaces of articles during shipping of such articles comprising self-locking honeycomb panels. In one embodiment, the protector includes first and second unitary panels separated by a channel about which the panels are foldable. The first panel includes a lip which fits into a slit in the second panel to connect and lock the first and second panels in position.

19 Claims, 8 Drawing Sheets

METHOD FOR FORMING A HONEYCOMB CORNER PROTECTOR WITH SELF-LOCKING PANELS

This is a divisional of co-pending application Ser. No. 08/640,661 now U.S. Pat. No. 5,680,934 filed May 1, 1996.

TECHNICAL FIELD

This invention relates generally to a protector for an article to be packaged and, more particularly, to a honeycomb protector with self-locking panels.

BACKGROUND OF THE INVENTION

For many years, protectors have been secured to the edges and corners and other surfaces of manufactured articles such as appliances, electronic articles and doors, prior to such articles being packaged to protect the edges, corners and other surfaces of such articles from damage during handling and shipment.

A type of edge and corner protector currently in use is made of paper honeycomb material and is supplied to the manufacturer of the articles to be packaged in flat form. The panels of the protector are thereafter folded by the manufacturer, then taped, glued or stapled so that the protector remains folded, and then is applied to the edges or corners of the article to be shipped.

A problem associated with the use of this type of corner protector is that it requires an extra manufacturing step, i.e., taping, gluing, or stapling during the folding operation. There is also a tendency to unfold and fall off the article prior to the article being packaged, thus complicating and unnecessarily decreasing the efficiency of the packing operation. Thus, there remains a need for a corner protector which does not require taping, gluing, or stapling during the folding operation and which will not unfold and fall off the edge or corner of the article prior to or during packaging the article.

U.S. Pat. No. 5,511,667 to Carder discloses a honeycomb corner protector which is supplied to the manufacturer in a flat form. The protector comprises a panel including panel portions which are folded along crush slit scores and then interlocked by means of fingers and notches therein. Although this corner protector has proven to be extremely effective and reliable in that it dispenses the need for taping, gluing and stapling, its use is limited to the protection of the corners of articles.

Additionally, all current protectors comprise panels foldable into a perpendicular relationship thus limiting their use to the corners or edges of an article.

The present invention solves these problems by providing a self-locking honeycomb protector with foldable or connectable honeycomb panels which can be used on the edges, corners or other surfaces of an article to be packaged and which is easy to manufacture and assemble.

SUMMARY OF THE INVENTION

The present invention is a honeycomb protector for protecting the corners, edges or other surfaces of articles during shipping of such articles which comprises first and second panels, each of the panels including a core having opposite faces and a face sheet secured to one of the faces and defining a peripheral edge. Each of the first and second panels include sidewalls defined by the core. One of the sidewalls of the first panel is offset inwardly from the respective peripheral edge of the face sheet such that the face sheet defines a longitudinally extending lip. The second panel includes a slit extending through the face sheet, the lip on the first panel fitting within the slit in the second panel to connect and self-lock the first and second panels together.

In one embodiment suitable for protecting the edges or other surfaces of the article, the protector includes first and second panels separated by a channel about which the panels are foldable. The first panel includes a lip which fits into a slit in the second panel to connect the first and second panels in the folded position. The width of the channel may be varied to vary the angular relationship between the first and second panels in the folded position.

In another embodiment, the protector includes a first panel including one or more lips or prongs and a separately connectable second panel including one or more slits defining sockets for receiving the lips of the first panel and securing the first and second panels together in various angular and positional configurations.

In yet another embodiment, the protector includes a third panel foldably connected to the first and second panel. The third panel includes a lip insertable into a second slit in the second panel to hold the first, second and third panels in the folded position.

Finally, several methods and an apparatus is disclosed for making the protector of the present invention.

The honeycomb protector of the present invention initially solves the problems with gluing, taping or stapling by providing self-locking panels. The invention further provides a protector which can be used for many applications including, but not limited to, the protection of edges and corners of articles, the protection of articles having a variety of angular configurations, and the stacking or arrangement of articles such as bottles in side-by-side relationship for shipping.

There are other advantages and features of the present invention which will be more readily apparent from the following detailed description of the preferred embodiments of the invention, the drawings, and the appended claims.

BRIEF DESCRIPTION OF THE DRAWINGS

In the accompanying drawings which form a portion of this disclosure.

DESCRIPTION OF THE PREFERRED EMBODIMENTS

Figure 1:
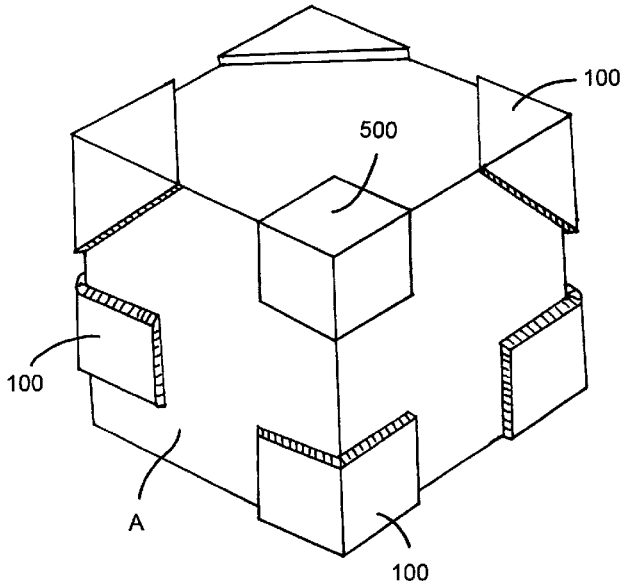
FIG. 1 is a perspective view of a box-like article with alternate embodiments of protectors constructed in accordance with the present invention positioned over the corners and edges thereof.

An article A is shown in FIG. 1 with protectors 100 and 500 of the present invention positioned over its edges and corners for protecting the corners and edges of the article A from damage during handling and shipping. The article A may be a manufactured good such as an appliance or electronic article such as a television.

Figure 2:
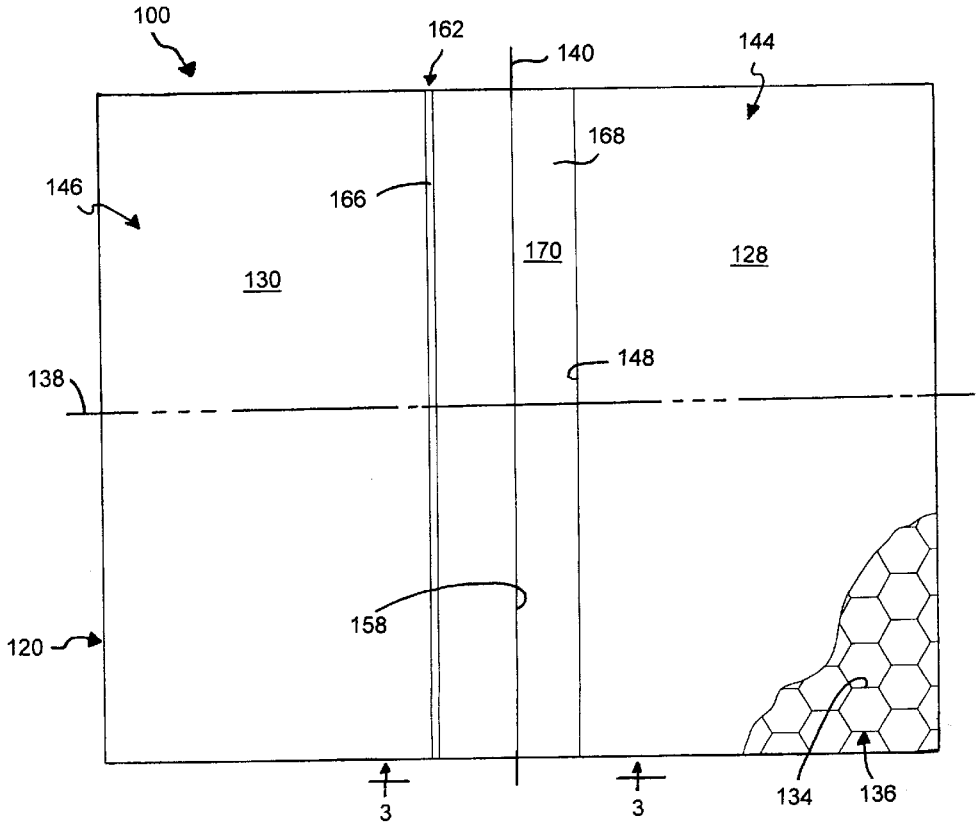
FIG. 2 is a plan view of a first embodiment of a protector in its flat form.
Figure 3:
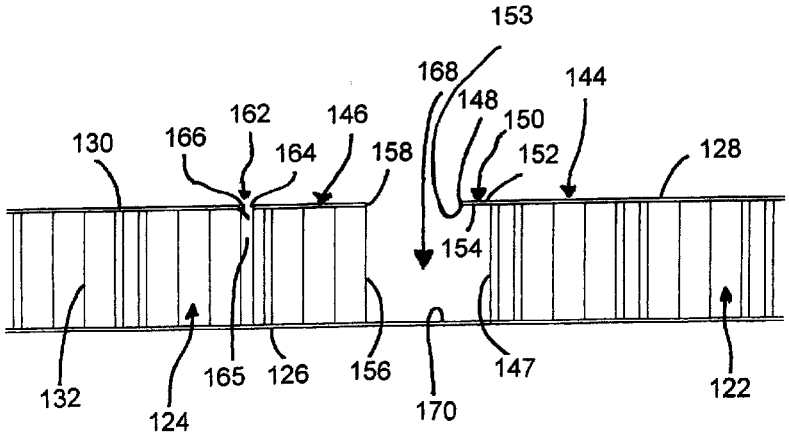
FIG. 3 is an enlarged, fragmentary end view of the edge protector taken along the lines 3—3 of FIG. 2.

A self-locking edge protector 100 is depicted in FIGS. 2–5. Referring to FIGS. 2 and 3, protector 100 comprises a generally rectangular panel 120 including separate and spaced apart first and second core portions 122 and 124 sandwiched between and adhesively secured to a first or bottom face sheet 126 and first and second top face sheets 128 and 130 respectively. Each of the first and second core portions 122 and 124 respectively is a honeycomb core comprised of a plurality of abutting partition walls 132 which are positioned perpendicularly to the bottom face sheet 126 and the first and second top face sheets 128 and 130. The partition walls 132 form hexagonal cells 134 having opposed hollow-cell faces 136 to which the bottom face sheet 126 and the first and second top face sheets 128 and 130 are adhesively secured.

Preferably, the core portions 122 and 124 and the face sheets 126, 128 and 130 are made of a kraft paper. The face sheets can be made of different weights of paper with 42 pound, 69 pound and 90 pound being preferred. Materials other than paper can also be used. The panel 120 in its flat form (FIG. 2) preferably measures about 6×10 inches (about 15 by 25 cm.) with a core thickness of about 1 inch (about 2.5 cm.). Although the above dimensions are preferable for most applications, they are not limiting. It is also understood that the invention is not limited to rectangularly shaped protectors and is applicable to any other shaped protectors such as, for example, the triangularly shaped protector 100 depicted in FIG. 1.

Referring back to FIG. 2, panel 120 includes a central longitudinal axis 138 and a central transverse axis 140 and the core portions 122 and 124 divide the panel 120 into first and second panel portions 144 and 146.

The first panel portion 144 includes an extended inner longitudinal sidewall 147 defined by the generally vertical partition walls 132 of the core portion 122 and terminating at the top face sheet 128 thereof in an extended longitudinal inner peripheral edge 148 defined by the inner peripheral edge of the top face sheet 128. Inner sidewall 147 and edge 148 extend longitudinally along the length of and offset from the central transverse axis 140 of panel 120. The inner sidewall 147 is offset inwardly from the inner edge 148 to define a lip or prong 150 including a tip 153 and upper and lower surfaces 152 and 154.

Second panel portion 146 includes an extended inner longitudinal sidewall 156 defined by the generally vertical partition walls 132 of the core portion 124 which terminates at the top face sheet 130 thereof in an extended longitudinal inner peripheral edge 158 defined by the inner peripheral edge of the top face sheet 130. The inner sidewall 156 and edge 158 are disposed generally co-planarly with the central transverse axis 140 of panel 120.

Second panel portion 146 also includes a slit 162 which extends through the top face sheet 130 and preferably a segment of the core portion 124. Slit 162 extends longitudinally along and parallel to the central transverse axis 140 of the panel 120 and the inner peripheral edge 158 of second panel portion 146. Slit 162 is offset from the central transverse axis 140 of panel 120 and the inner edge 158 of panel portion 146 by a distance approximately equal to the thickness of the first core portion 122. Slit 162 is defined by an opening 164 in the top face sheet 130, a socket 165 in the core portion 124, and a beveled surface 166 therebetween. The opening 164 is between the beveled surface 166 and the sidewall 156 of second panel portion 146. The slit 162 is configured to cooperatively receive and preferably retain the lip 150. The beveled surface 166 helps retain the lip 150 in the socket 165.

Inner sidewalls 147 and 156 and inner edges 148 and 158 of first and second panel portions 144 and 146 respectively are opposed and spaced-apart from each other to define a cavity in the form of an extended channel 168 extending longitudinally along the length of and offset from the central transverse axis 140 of panel 120. Channel 168 has a width which is about equal to the thickness of the second core portion 124.

Channel 168 is generally rectangularly shaped and includes a generally horizontal bottom surface 170 defined by the bottom face sheet 126, a first generally vertical side face defined by the inner sidewall 147 of first panel portion 144, an opposite generally vertical side face defined by the inner sidewall 156 of second panel portion 146, and a top opening defined by the inner longitudinal spaced-apart edges 148 and 158 of first and second panel portions 144 and 146 respectively.

Figure 4:
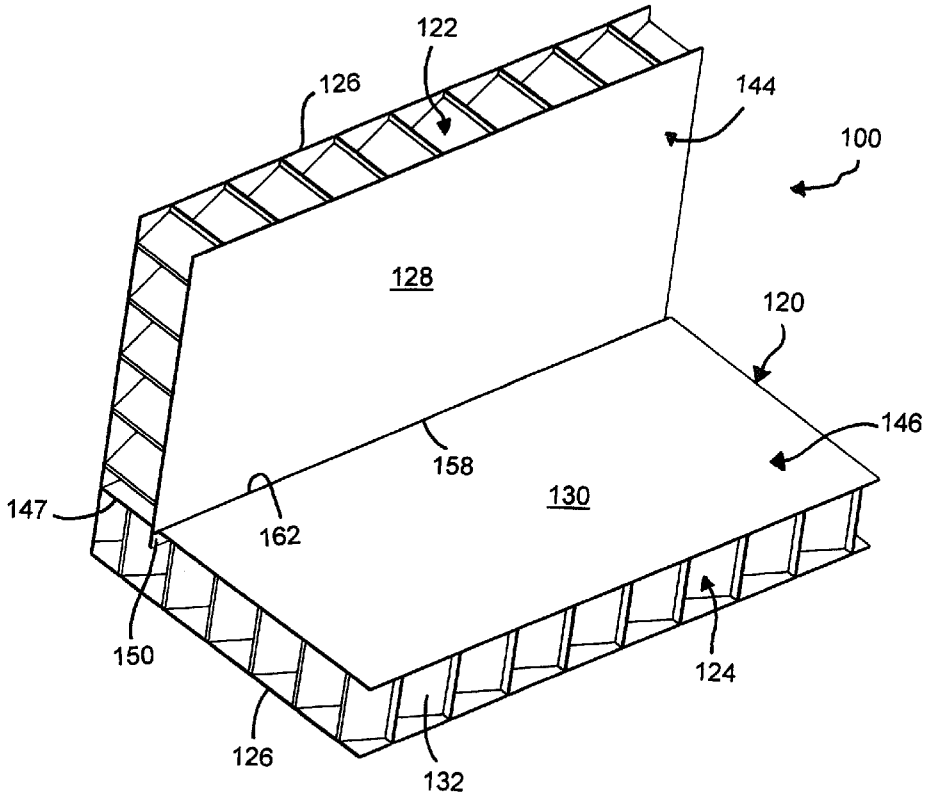
FIG. 4 is a perspective view of the protector of FIG. 2 in its folded position.

The portion of the bottom face sheet 126 comprising the bottom surface 170 of channel 168, in combination with the central transverse axis 140, define a hinge about which the panel portions 144 and 146 are folded to form the protector 100 shown in FIG. 4.

Figure 5:
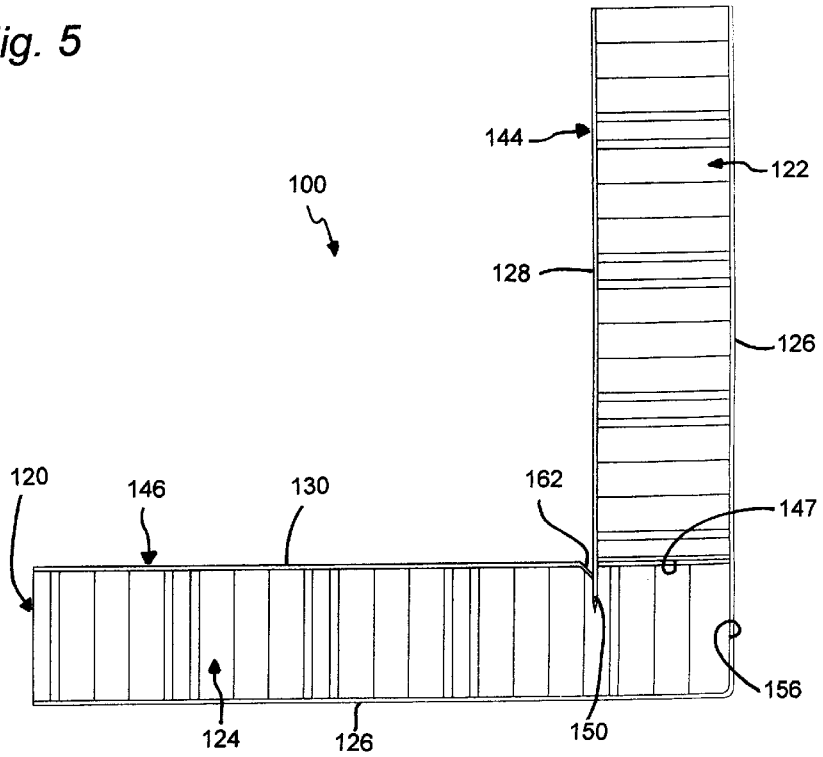
FIG. 5 is an end elevational view of the protector of FIG. 4 in its folded position.

To form the protector 100, first and second panel portions 144 and 146 are rotated upwardly and inwardly towards each other about the channel 168 until the first and second panel portions 144 and 146 are positioned generally perpendicularly to each other as shown in FIGS. 4 and 5. The portion of the bottom face sheet 126 comprising the bottom surface 170 of channel 168 is then in abutting generally vertical relationship with the inner sidewall 156 of second panel portion 146 and the inner sidewall 147 of first panel portion 144 is in abutting generally horizontal relationship with the top inner periphery of the second panel portion 146.

To lock the first and second panel portions 144 and 146 together in their generally perpendicular folded position, the lip 150 on the first panel portion 144 is inserted vertically downwardly into the slit 162 in the second panel portion 146. More particularly, the lip 150 is inserted through the opening 164 of slit 162 with the tip thereof in abutting relationship with the beveled surface 166 thereof to cause the lip 150 to slide into the socket 165.

The use of a lip 150 cooperating and fitting within a slit 162 dispenses with the need to tape, glue, or staple the first and second panel portions 144 and 146 together during the folding operation. If desired, glue or tape can also be placed over the lip 150 to further lock the panels in a folded relationship. The protector 100 may be made without a lip 150 or cooperating slit 162 if desired.

Figure 6:
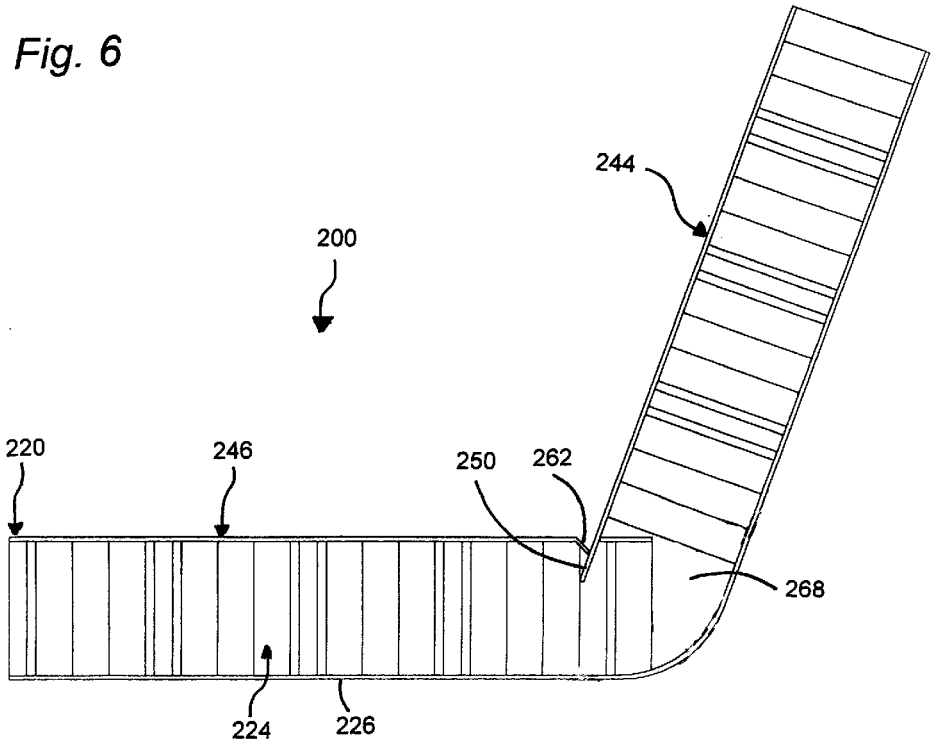
FIG. 6 is an end elevational view of a second embodiment of a protector in its folded position.

FIG. 6 shows an alternate protector 200 which is similar to the corner protector 100 except that the channel 268 of panel 220 has a width that is less than the thickness of the second core portion 224. When the first and second panel portions 244 and 246 are folded together and the lip 250 on first panel portion 244 is inserted into the slit 262 in the second panel portion 246, the first and second panel portions 244 and 246 are locked together in a folded position where the included angle between the first and second panel portions 244 and 246 is greater than 90 degrees.

The protector 200 is particularly applicable where it is desired to protect the corners or edges of articles having surfaces oriented at other than 90 degrees. The width of the channel 268 can be varied depending upon the angular characteristics of the surface of the article sought to be packaged. Additionally, in an application where extra cushioning or impact protection is desired, the second panel portion 246 can be constructed with two or more pieces of core (and possibly face sheets) to provide the core portions 224. In this application, the width of the channel 268 would be increased to about the thickness of the two stacked core portions 224.

Figure 7:
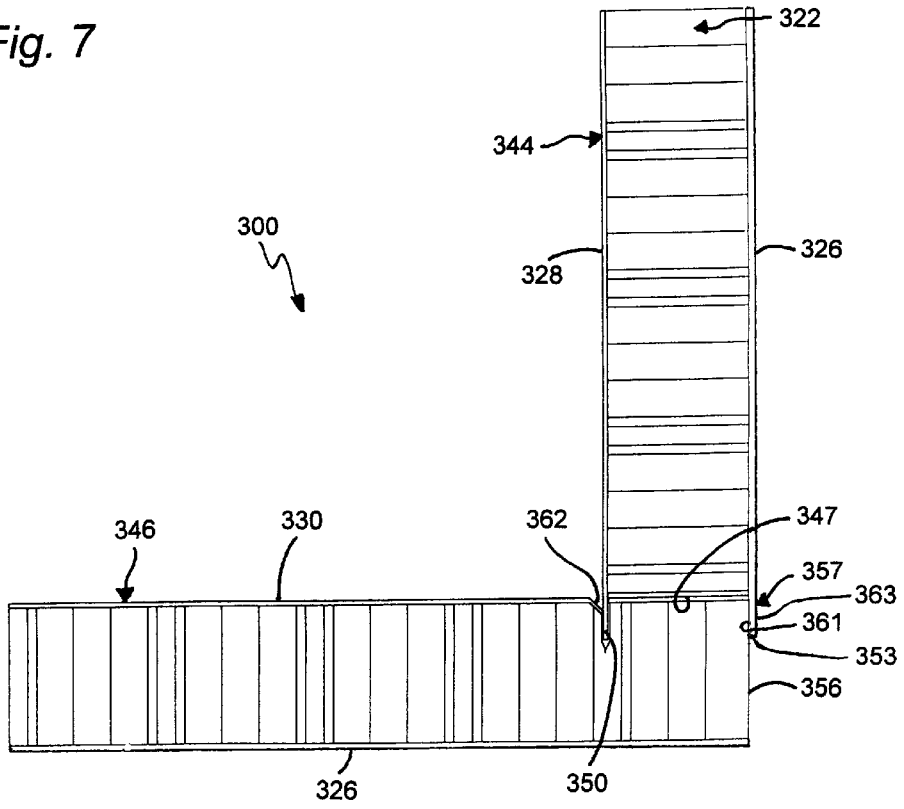
FIG. 7 is an end elevational view of a third embodiment of a protector in its connected position.

FIG. 7 shows another protector embodiment 300 which is similar to protectors 100 and 200. Protector 300 differs from protectors 100 and 200 in that it comprises separately connectable first and second panels 344 and 346. Essentially, protector 300 comprises a protector 100 (FIG. 2) where the bottom face sheet 126 has been cut in the region of the channel 168. The first and second panels can also be made separately.

The first panel 344 of protector 300 is similar to the first panel portion 144 of protector 100 except that the bottom face sheet 326 thereof includes a peripheral edge 353.: The sidewall 347 of the core portion 322 of the first panel 344 is offset inwardly from the peripheral edge 353 of the bottom face sheet 326 to define a lip 357 opposite the lip 350 defined by the top face sheet 328. Lip 357 includes inner and outer surfaces 361 and 363 respectively.

The second panel 346 is similar to the second panel portion 146 of protector 100 except that the bottom face sheet 326 terminates at the inner sidewall 356. The distance between the slit 362 in the second panel 346 and the inner sidewall 356 thereof is approximately equal to the thickness of the core portion 322 of the first panel 344.

To connect the first and second panels 344 and 346 together, the first and second panels 344 and 346 are initially positioned substantially perpendicularly to each other as shown in FIG. 7. The first and second panels 344 and 346 are then connected together in a socket-like manner by inserting the lip or prong 350 of the first panel 344 into the slit 362 in the second panel 346 and placing the inner surface 361 of the lip 357 of the first panel 344 in abutting relationship with the inner sidewall 356 of the second panel 346 and then pushing the first and second panels 344 and 346 together until the lip 350 is fully inserted into the socket 365 defined by the slit 362 and the inner sidewall 347 of the first panel 344 is placed into abutting relationship with the top face sheet 330 of the second panel 346.

Figure 8:
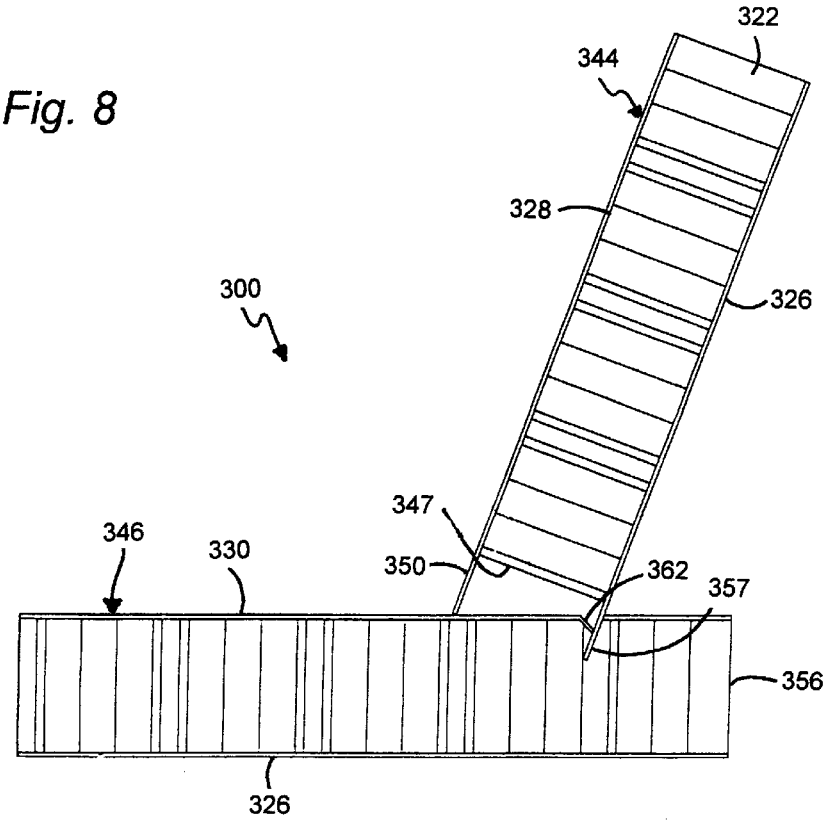
FIG. 8 is an end elevational view of a alternate connection of the panels of the protector of FIG. 7.

FIG. 8 shows an alternate connection of the first and second panels 344 and 346 of protector 300 where the lip 357 of the first panel 344 is inserted into the socket 365 defined by the slit 362 in the second panel 346. The tip of the opposite lip 350 of the first panel 344 is placed against the top face sheet 330 of the second panel 346 to form a protector 300, similar to the protector 200 of FIG. 6, where the first and second panels 344 and 346 are positioned with respect to each other at an included angle greater than 90 degrees to suit the same purposes as described earlier with the protector 200 of FIG. 6.

Figure 9:
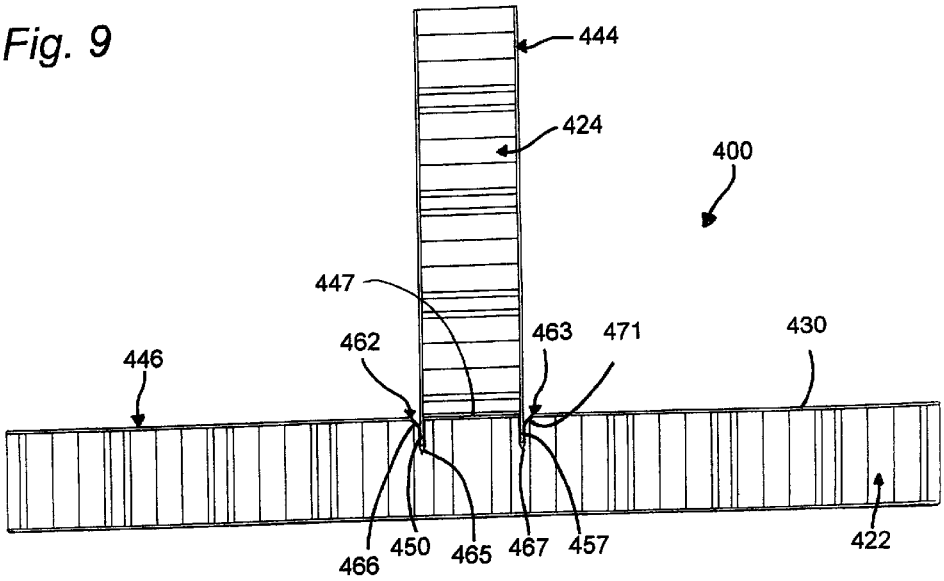
FIG. 9 is an end elevational view of a third embodiment of a protector in its connected position.

FIG. 9 shows yet another protector embodiment 400 similar to protector 300.

The first panel 444 of protector 400 is similar to the first panel 344 of protector 300 (FIG. 7) and thus similar to the first panel portion 144 of protector 100 (FIG. 2).

The second panel 446 of protector 400 is similar to the second panel 346 of protector 300 (FIG. 7) and thus similar to the second panel portion 146 of protector 100 (FIG. 2) except that second panel 446 includes first and second spaced-apart slits 462 and 463 extending into the top face sheet 430 and a segment of the core portion 424 thereof to define first and second longitudinally extending sockets 465 and 467 respectively. The slits 462 and 463 include converging beveled surfaces 466 and 471 respectively. Slits 462 and 463 are spaced apart a distance approximately equal to the thickness of the core portion 422 of the first panel 444.

The first and second panels 444 and 446 are connected in a socket-like manner as shown in FIG. 9 by inserting the lips or prongs 450 and 457 on the first panel 444 into the sockets 465 and 467 respectively in the second panel 446. The beveled surfaces 466 and 471 of slits 462 and 463 respectively assist in guiding and sliding the lips 456 and 457 into the sockets. The first and second panels 444 and 446 are then pushed together until the sidewall 447 of the first panel 444 abuts the top face sheet 430 of the second panel 446.

In this configuration, articles to be packaged such as bottles or like can be placed on the surface of the panel 446 on opposite sides of the first panel 444. Although not shown, it is understood that the second or bottom panel 346 can include additional sets of slits spaced along the length thereof adapted to receive additional first panels 344 for packaging several articles such as bottles or the like in side-by-side relationship. Moreover, the protector 400 can be made into the protector 300 by adding a slit in the second panel 446 adjacent the sidewall 456 thereof.

FIGS. 10–13 depict a self-locking corner protector embodiment 500 of the self-locking edge protector 100.

Figure 10:
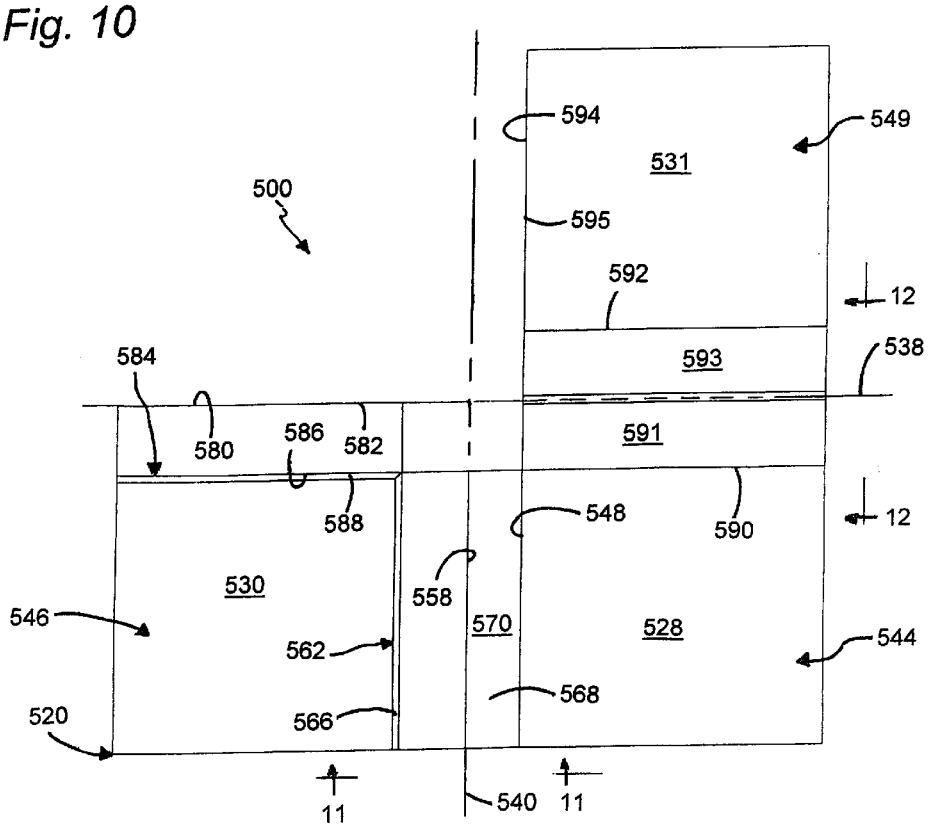
FIG. 10 is a plan view of a corner protector embodiment of the protector of FIG. 2.
Figure 11:
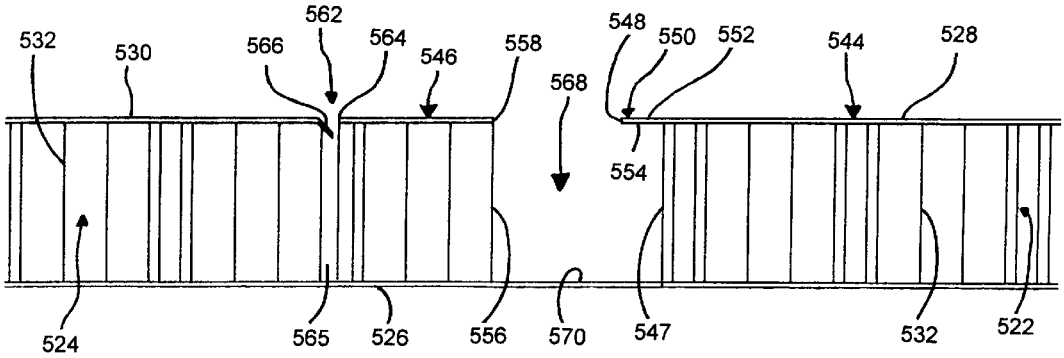
FIG. 11 is an enlarged, fragmentary end view of the corner protector taken along the lines 11—11 of FIG. 10.
Figure 12:
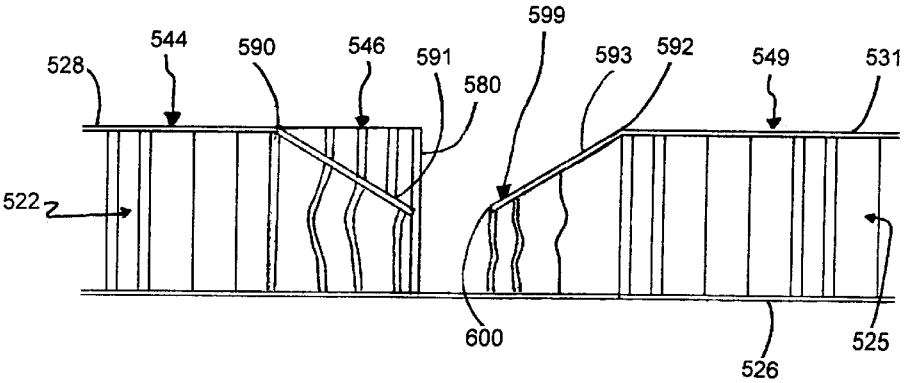
FIG. 12 is an enlarged, fragmentary end view of the corner protector taken along the lines 12—12 of FIG. 10.

Referring to FIGS. 10–12, protector 500 comprises a panel 520 including separate and spaced apart core portions 522, 524 and 525 sandwiched between and adhesively secured to a first or bottom face sheet 526 and three top face sheets 528, 530 and 531 respectively. Each of the core portions 522, 524 and 525 is a honeycomb core similar to the honeycomb core of protector 100.

Panel 520 includes a central longitudinal axis 538 and a central transverse axis 540. The core portions 522, 524 and 525 divide the panel 520 into first, second and third panel portions 544, 546 and 549.

The first panel portion 544 is similar to the first panel portion 144 of protector 100 (FIGS. 2 and 3) and includes an extended inner longitudinal sidewall 547 defined by the generally vertical partition walls 532 of the first core portion 522 and terminating at the top face sheet 528 thereof in an extended longitudinal inner peripheral edge 548 defined by the inner peripheral edge of the top face sheet 528. Inner sidewall 547 and edge 548 extend longitudinally along the length of and offset from the central transverse axis 540 of panel 520. The inner sidewall 547 is offset inwardly from the inner edge 548 to define a lip 550 including upper and lower surfaces 552 and 554.

First panel portion 544 further includes a second inner peripheral edge 590 and an inclined surface 591 which converges into and is generally perpendicular to the inner peripheral edge 548. Inner peripheral edge 590 extends parallel along and is offset from the central longitudinal axis 538.

Second panel portion 546 is similar to the second panel portion 146 of protector 100 (FIGS. 2 and 3) and includes an extended inner longitudinal sidewall 556 defined by the generally vertical partition walls 532 of the core portion 524 that terminates at the top face sheet 530 thereof in an extended longitudinal inner peripheral edge 558 defined by the inner peripheral edge of the top face sheet 530. The inner sidewall 556 and edge 558 are disposed generally co-planar with the central transverse axis 540 of panel 520.

Second panel portion 546 also includes a slit 562 which extends generally vertically downwardly through the top face sheet 530 and a segment of the core portion 524. Slit 562 extends longitudinally along and parallel to the central transverse axis 540 of the panel portion 546. Slit 562 is offset from the central transverse axis 540 of panel 520 and the inner edge 558 of second panel portion 546 a distance approximately equal to the thickness of the first core portion 522. The slit 562 is defined by an opening 564 in the top face sheet 530, a socket 565 in the second core portion 524 and a beveled surface 566 therebetween.

The second panel portion 546 additionally includes an extended inner longitudinal sidewall 580 defined by the generally vertical partition walls 532 of the second core portion 524 and terminating at the top face sheet 530 in an extended longitudinal edge 582. Sidewall 580 and edge 582 extend longitudinally along and generally co-planarly with the central longitudinal axis 538 of panel 520.

The second panel portion 546 includes a second slit 584 which extends generally vertically downwardly through the top face sheet 530 and a segment of the second core portion 524 and extends longitudinally along and parallel to the central longitudinal axis 538 of panel 520. Slit 584 is offset from the inner longitudinal edge 582 of second panel portion 546 a distance of about the thickness of the third core portion 525. Slit 584 is defined by an opening 586 in the top face sheet 530 and a beveled surface 588 extending inwardly in the direction of inner sidewall 580. Slit 584 converges into and is positioned generally perpendicularly to the slit 562 in the second panel portion 546.

Inner sidewalls 547 and 556 and inner edges 548 and 558 of first and second panel portions 544 and 546 respectively are opposed and spaced-apart from each other to define a cavity in the form of an extended channel 568 similar to the channel 168 of protector 100 (FIG. 3).

Channel 568 extends longitudinally along the length of and is offset from the central transverse axis 540 of panel 520. Channel 568 has a width which is about equal to the thickness of the second core portion 524.

Channel 568 is generally rectangularly shaped and includes a generally horizontal bottom surface 570 defined by the bottom face sheet 526, a first generally vertical side face defined by the inner sidewall 547 of first panel portion 544, an opposite generally vertical side face defined by the inner sidewall 556 of second panel portion 546, and a top opening defined by the inner longitudinal space-apart edges 548 and 558 of panel portions 544 and 546 respectively.

The portion of the bottom face sheet 526 comprising the bottom surface 570 of channel 568, in combination with the central transverse axis 540, define a hinge about which the panel portions 544 and 546 are folded.

The third panel portion 549 is a generally rectangular member including an inner peripheral edge 592 and an inclined surface 593. Inner peripheral edge 592 extends generally parallel to and offset from the central longitudinal axis 538. Inner peripheral edge 592 and surface 593 are disposed opposite inner peripheral edge 590 and surface 591 of first panel portion 544. Third panel portion 549 further includes an inner sidewall 594 defined by the upstanding partition walls 532 of third core portion 525 and terminating at the top face sheet 531 in an extended longitudinal inner edge 595 which converges into and is generally perpendicular to the peripheral edge 592. Inner sidewall 594 and edge 595 extend along and are offset from the central transverse axis 540 of panel 520. Inner sidewall 594 is offset inwardly from the inner edge 595 thereof to define a longitudinally extending lip 596 including upper and lower surfaces 597 and 598 respectively.

Figure 13:
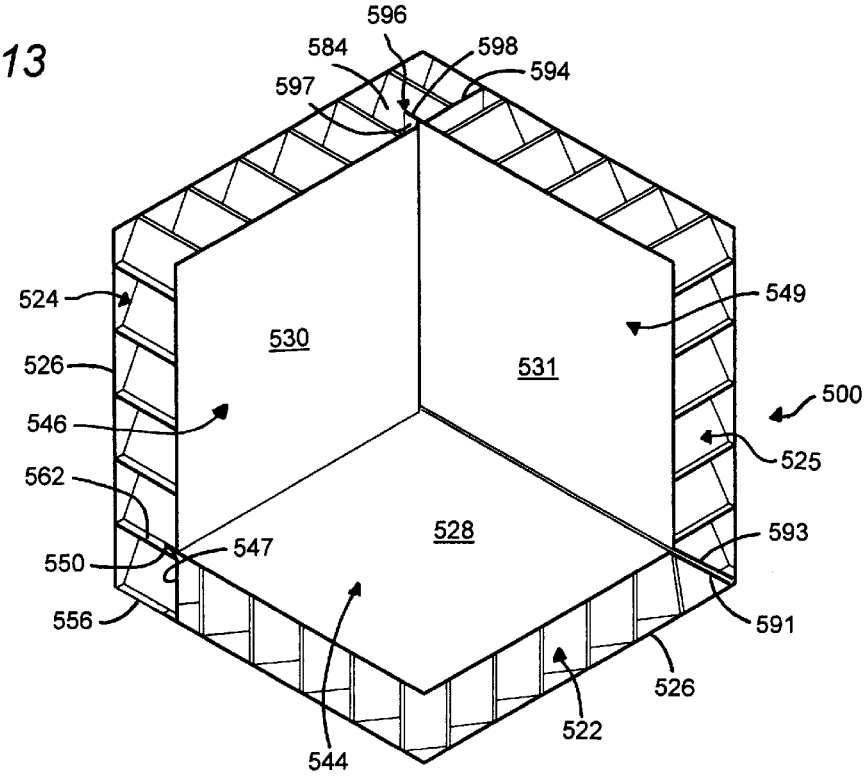
FIG. 13 is a perspective view of the corner protector of FIG. 10 in its folded position.

The third panel portion 549 is connected to the first panel portion 544 by a cavity in the form of an angle crush slit score 599 comprised of a longitudinally extending central slit 600 which is cut through the top face sheets 528 and 531, and the opposed inclined surfaces 591 and 593 of the first and third panel portions 544 and 547 respectively. As is described in detail in U.S. Pat. No. 5,511,667 to Carder, the surfaces 591 and 593 are inclined at a bevel angle to provide a spring biasing action between the surfaces when the first and third panel portions 544 and 549 are folded and connected together as shown in FIG. 13. It is also possible to combine the lip and slit arrangement with angle crush slit score by placing additional cuts in surfaces 591 and 593 (or the flat of the face sheet if desired) to form the lip out of part of one of the inclined surfaces which fits into the slit associated with the opposing inclined surface.

The corner protector 500 is shown in FIG. 13 in its folded and connected position. Preferably, the corner protector 500 is assembled by initially rotating the first and second panel portions 544 and 546, respectively, upwardly and inwardly about the channel 568 until the first and second panel portions 544 and 546 are positioned generally perpendicularly to each other and the bottom face sheet 526 is in abutting generally vertical relationship with the inner sidewall 556 of second panel portion 546 and the inner sidewall 547 of first panel portion 544 is in abutting generally horizontal relationship with the top inner peripheral portion of second panel portion 546. The first and second panel portions 544 and 546 are then locked together in their folded position by inserting the lip 550 on the first panel portion 544 into the slit 562 in the second panel portion 546.

The third panel portion 549 is connected to the first panel portion 444 in a similar fashion. More particularly, the third panel portion 549 is rotated upwardly and inwardly in the direction of the first panel portion 444 about the angle crush slit score 599 until the surfaces 591 and 593 of the first and third panel portions 544 and 549 are placed in abutting relation. The first, second and third panel portions 544, 546 and 549 are then locked together by inserting the lip 596 on the third panel portion 549 into the slit 584 in the second panel portion 546. The spring biasing action provided by the angle crush slit score 599 enhances the locking of the lip 596 in the slit 584. The corner protector 500 may then be applied to the corner of the article to be protected.

It is understood that although the corner protector 500 has been described as including cavities in the form of a channel 568 and a crush slit score 599 dividing the first and second portions and the first and third portions respectively, the invention contemplates and encompasses corner protector embodiments where a cavity in the form of a crush slit score is substituted for the channel 568 or, alternatively, a cavity in the form of a channel is substituted for the angle crush slit score 599. The channels and crush slit scores may also be substituted altogether and replaced with any other suitable cavity or structure which allows for the folding of panel portions. The folding structure selected would determine which of the panel portions would include the slits and lips covered by the invention.

Figure 14:
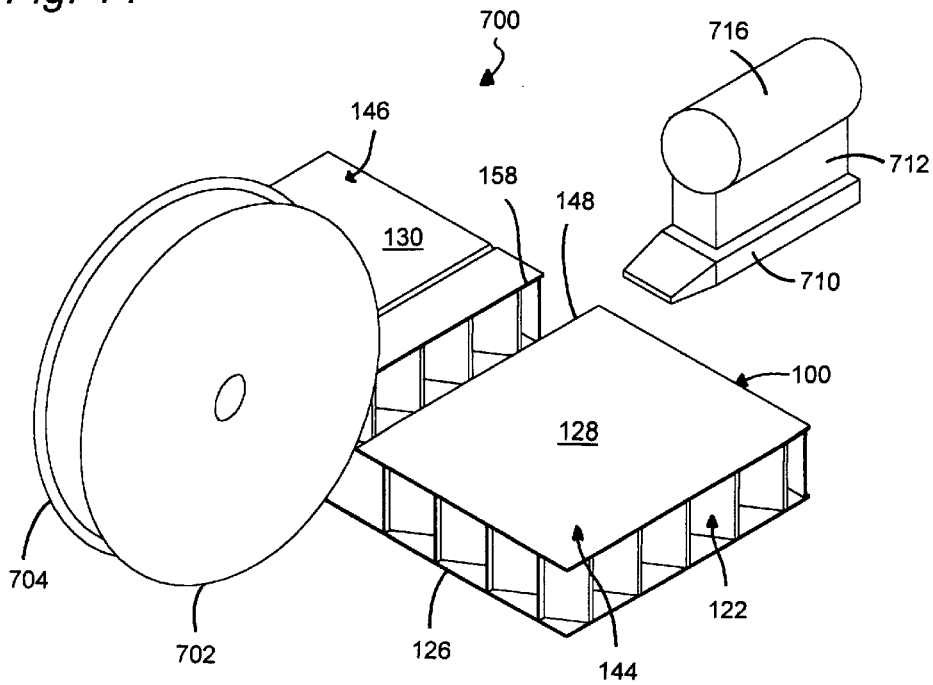
FIG. 14 is a simplified, schematic perspective view of an apparatus for making the protector.
Figure 15:
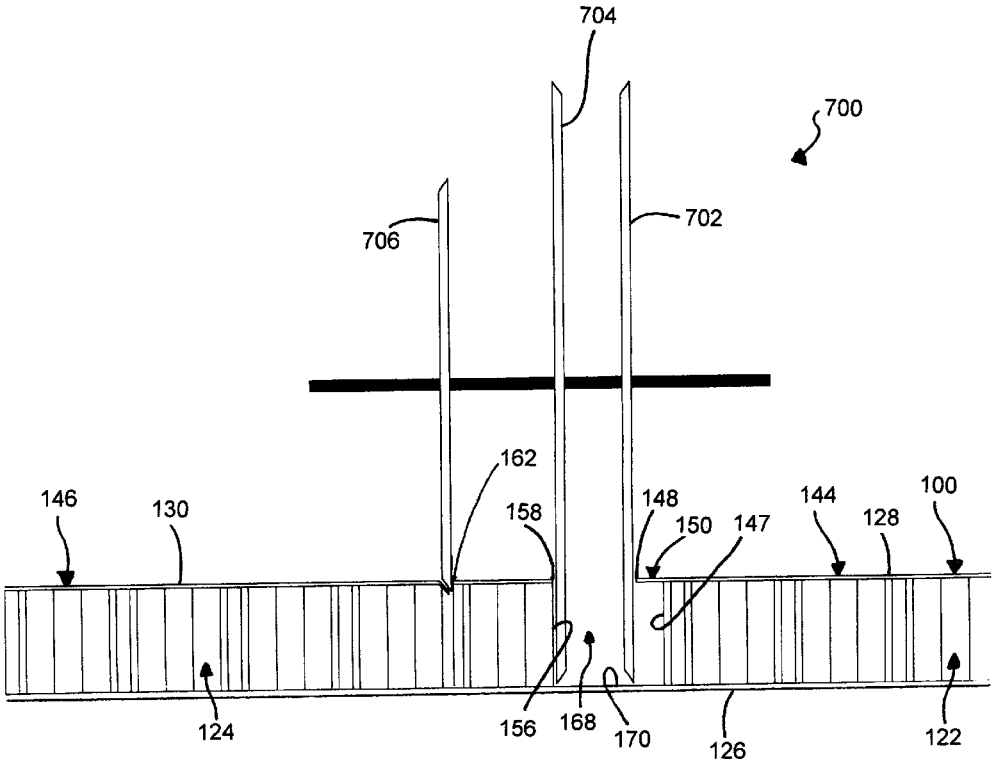
FIG. 15 is a simplified, schematic front elevational view of the apparatus of FIG. 14.

The methods for making the self-locking protectors 100 and 500 will now be described with reference to FIGS. 14 and 15 which show, in schematic form, an apparatus 700 and method for making the protector 100.

Initially, and although not shown, a panel 120 is preferably formed by feeding an extended length of core through an "in-line" continuous flow panel line where top and bottom face sheets are adhesively secured to the top and bottom hollow cell faces of the core. The resulting panel 120 is then introduced into the apparatus 700 which includes slitting means such as rotary saws or circular knife slitters 702, 704 and 706. The first and second slitters 702 and 704 are positioned with respect to the panel 120 in a spaced apart side-by-side relationship to cut first and second spaced-apart parallel slits in the top face sheet and the core of panel 120 to define the inner edges 148 and 158 and the inner sidewalls 147 and 156 of first and second panel portions 144 and 146 respectively.

The third slitter 706 is positioned parallel to the first and second slitters 702 and 704 to cut the slit 162 in the second panel portion 146 of panel 120.

After the slitters 702 and 704 have cut through the top face sheet and core of panel 120, a separator 710 in the form of a scrapper or the like is used to separate and strip the core which has been cut from the bottom face sheet 126. A wedge 712 mounted to the top surface of the separator 710 is then used to push the inner sidewall 147 of first panel portion 144 inwardly so as to form the lip 150. Alternatively, a roller can be used. The glue that remains on the bottom of the lip 150 reinforces it and strengthens the paper. It is preferred that this operation be conducted before the glue is dry.

Removal means in the form of a vacuum 716 or the like is then used to remove the core and face sheet segment which has been separated from the bottom face sheet 126 to define the cavity 168 in panel 120.

In accordance with this method, and to make the separation and removal of the core segment easier, it is desirable that the core segment of panel 120 which is cut and removed to form the cavity 168 not be adhesively secured to the strip of the bottom face sheet 126 beneath the core segment.

Although not shown, it is understood that this can be accomplished by damming the glue spreader, which spreads the glue onto the top and bottom hollow cell faces of the core prior to the top and bottom face sheets being secured thereto, in the area of the core comprising the core segment to be later removed.

Alternatively, and in lieu of damming the glue spreader, the core segment to be removed can be punched at predetermined spaced intervals to create dimples or hourglass-shaped inner recesses into which glue is not received when the glue is spread onto the hollow-cell face thereof. As a result, a hollow-cell face area is created with a smaller adhesive core surface area making it easier to separate from the bottom face sheet 126.

In an alternative method, and although not shown, panel 120 can be made by securing two core portions 122 and 124 in a spaced-apart relationship on a bottom face sheet 126 and then applying the top face sheets 128 and 130 to the top of the core portions 122 and 124 respectively to form a panel 120 including panel portions 144 and 146 separated by a cavity 168. Alternatively, two panel portions 144 and 146 already including core sections and top and bottom face sheets can be secured to a backing member in a spaced apart relationship to create a cavity therebetween.

A roller apparatus (not shown) could then be used to push in the sidewall of the selected panel portion to form the desired lip and a slitter would be used to form the slit in the other panel portion. This method eliminates several manufacturing steps such as the need to slit and remove a core segment to form the cavity 168 and thus the glue damming or core dimple forming steps. It also reduces the amount of paper material which is wasted during the manufacturing operation.

It is understood that the methods described above can be performed by an "in-line" apparatus such as an "in-line" continuous feed panel line where core is provided and fed on a conveyor through a first station where top and bottom face sheets are provided and applied thereto, a second station where stationary slitters 702, 704 and 706 would cut the panel as its travels past the slitters, and a third station where the core segment would be separated and removed from the panel 120 by a stationary separator 710 and vacuum 716. Alternatively, the core and face sheets could be fed into the panel line in spaced-apart segments so as to eliminate the need to cut out any core or face sheet segments from the panel. As a still further alternative, a die press can used.

The method of making a corner protector with first, second and third panel portions is similar to the methods described herein for making the protector with first and second panel portions.

The foregoing is illustrative of the principles of the invention. Further, since numerous modifications and changes will readily occur to those skilled in the art, it is not desired to limit the invention to the exact construction and operation shown and described. Accordingly, all suitable modifications and equivalents may be resorted to while still falling within the scope of the invention.

What is claimed is:

1. A method of making a protector from a panel including a core and a bottom face sheet comprising the steps of: a) providing a bottom face sheet; b) providing core on the bottom face sheet to define the panel; c) dividing the panel into first and second panel portions each including an inner generally upstanding vertical sidewall connected to the bottom face sheet defining a cavity, the first and second panel portions being foldable about the cavity to form the protector, the second sidewall terminating at the cavity in an inner longitudinally extending edge; and d) forming a lip at the inner edge.

2. The method of claim 1 further comprising the step of folding the first and second panel portions about the cavity to form the protector.

3. The method of claim 2 wherein the first and second panel portions are positioned generally perpendicularly to each other in the folded position and the inner sidewall of the second panel portion is disposed generally horizontally against a top of the first panel portion.

4. The method of claim 1 wherein a top face sheet is on a side of the core opposite the bottom face sheet of each panel portion.

5. The method of claim 1 wherein the steps of providing core includes the step of providing first and second core portions which are positioned and secured to the bottom face sheet in spaced apart relationship to define the cavity in the panel.

6. The method of claim 5 further comprising the step of providing first and second face sheet portions which are secured to a top of the first and second core portions respectively.

7. The method of claim 1 wherein the step of providing a bottom face sheet includes the step of providing first and second core portions and first and second bottom face sheet portions, the method further comprising the steps of securing the first and second bottom sheet portions to the first and second core portions respectively to define the first and second panel portions, the first and second panel portions being placed in spaced apart relationship on a bottom backing member to define the panel, the cavity being defined by a space between the first and second panel portions.

8. The method of claim 7 further comprising the step of providing first and second top face sheet portions which are secured to a top of the first and second panel portions respectively.

9. The method of claim 1 further comprising the steps of: providing a top face sheet which is secured to a top of the core prior to step b, cutting first and second longitudinally extending spaced apart slits in the panel after step b, the first and second slits extending through the top face sheet and the core, and removing the core and the top face sheet from the panel to form the cavity.

10. A method of making a protector comprising the steps of:

a) providing a panel including a core sandwiched between top and bottom face sheets, the panel has a central longitudinal axis and a central transverse axis;

b) cutting first and second parallel slits in the panel along the transverse axis, the first and second slits being spaced apart from each other and extending through the top face sheet and the core; and c) removing the core and the top face sheet between the first and second slits leaving the bottom face sheet intact to form a panel including first and second spaced apart panel portions and a cavity therebetween, the first and second panel portions being foldable about the cavity to form the protector, the second panel portion includes an inner generally vertical sidewall terminating at the top face sheet in an inner longitudinally extending edge; and d) forming a lip at the inner edge.

11. The method of claim 10 further comprising the step of cutting a third slit in the first panel portion, the third slit being spaced from and parallel to the second slit and extending through the top face sheet and a portion of the core, the first and second portions being foldable about the cavity and the lip on the second panel portion fitting within the third slit to lock the first and second panel portions in the folded position.

12. The method of claim 10 further comprising the steps of cutting third and fourth parallel slits along the central longitudinal axis, the third and fourth slits being spaced apart from each other and extending through the top face sheet and the core, and removing the core and the top face sheet between the third and fourth slits to form a panel including a third panel portion and second cavity therebetween, the first and third panel portions being foldable about the second cavity to form the protector.

13. The method of claim 12 wherein each of the second and third panel portions includes an inner generally vertical sidewall terminating at the top face sheet in an inner longitudinally extending edge, the method further comprising the step of pushing the sidewall of the second and third panel portions inwardly into the core from the edge to form a lip at the edge of each of the second and third panel portions.

14. The method of claim 13 further comprising the step of cutting fifth and sixth slits in the first panel portion, the fifth slit being spaced from and parallel to the central transverse axis and extending through the top face sheet and a portion of the core, the first and second panel portions being foldable about the first cavity and the lip on the second panel portion fitting within the fifth slit in the first panel portion to lock the first and second panel portions in the folded position, the sixth slit being spaced from and parallel to the central longitudinal axis perpendicularly to the fifth slit and extending through the top face sheet and a portion of the core, the first and third panel portions being foldable about the second cavity and the lip on the third panel portion fitting within the sixth slit in the first panel portion to lock the first and third panel portions in the folded position to form the protector.

15. A method of making a protector comprising the steps of:

a) providing a panel including a core sandwiched between a top face sheet and a bottom face sheet;

b) defining a channel in said panel to divide said panel into first and second panel portions having opposing inner sidewalls and opposing peripheral edges of said top face sheet;

c) forming a longitudinally extending lip on said first panel portion such that said core of said first panel portion being offset inwardly into said core from said respective peripheral edge of said top face sheet; and d) cutting a longitudinally extending slit in said top face sheet of said second panel portion, said lip being capable of fitting into said slit to connect said first and second panel portions together.

16. The method of claim 15 further comprising the step of folding said first and second panel portions about said channel to form the protector.

17. The method of claim 16 further comprising the step of fitting said lip into said slit to connect said first and second panel portions together.

18. A method of making a protector comprising the steps of:

a) providing a panel including a core sandwiched between top and bottom face sheets, the panel has a central longitudinal axis and a central transverse axis;

b) cutting first and second parallel slits in the panel along the transverse axis, the first and second slits being spaced apart from each other and extending through the top face sheet and the core; and c) removing the core and the top face sheet between the first and second slits leaving the bottom face sheet intact to form a panel including first and second spaced apart panel portions and a cavity therebetween, the first and second panel portions being foldable about the cavity to form the protector;

d) cutting third and fourth parallel slits along the central longitudinal axis, the third and fourth slits being spaced apart from each other and extending through the top face sheet and the core e) removing the core and the top face sheet between the third and fourth slits to form a panel including a third panel portion and second cavity therebetween, the first and third panel portions being foldable about the second cavity to form the protector, each of the second and third panel portions includes an inner generally vertical sidewall terminating at the top face sheet in an inner longitudinally extending edge; and f) pushing the sidewall of the second and third panel portions inwardly into the core from the edge to form a lip at the edge of each of the second and third panel portions.

19. The method of claim 18 further comprising the step of cutting fifth and sixth slits in the first panel portion, the fifth slit being spaced from and parallel to the central transverse axis and extending through the top face sheet and a portion of the core, the first and second panel portions being foldable about the first cavity and the lip on the second panel portion fitting within the fifth slit in the first panel portion to lock the first and second panel portions in the folded position, the sixth slit being spaced from and parallel to the central longitudinal axis perpendicularly to the fifth slit and extending through the top face sheet and a portion of the core, the first and third panel portions being foldable about the second cavity and the lip on the third panel portion fitting within the sixth slit in the first panel portion to lock the first and third panel portions in the folded position to form the protector.

* * * * *